US010969098B2

(12) United States Patent
Wu et al.

(10) Patent No.: US 10,969,098 B2
(45) Date of Patent: Apr. 6, 2021

(54) COMBUSTION MACHINE

(71) Applicant: WUYI UNIVERSITY, Guangdong (CN)

(72) Inventors: Min Wu, Guangdong (CN); Yan Zhou, Guangdong (CN)

(73) Assignee: WUYI UNIVERSITY, Guangdong (CN)

( * ) Notice: Subject to any disclaimer, the term of this patent is extended or adjusted under 35 U.S.C. 154(b) by 91 days.

(21) Appl. No.: 16/390,125

(22) Filed: Apr. 22, 2019

(65) Prior Publication Data

US 2020/0300463 A1 Sep. 24, 2020

(30) Foreign Application Priority Data

Mar. 20, 2019 (CN) ..... 201910211708.4

(51) Int. Cl.

| | |
|---|---|
| ***F23G 5/04*** | (2006.01) |
| ***F23G 5/12*** | (2006.01) |
| ***F23G 5/14*** | (2006.01) |
| ***F23G 5/46*** | (2006.01) |
| ***F23G 7/10*** | (2006.01) |
| ***F23G 5/44*** | (2006.01) |

(52) U.S. Cl.

CPC ..... *F23G 5/04* (2013.01); *F23G 5/12* (2013.01); *F23G 5/14* (2013.01); *F23G 5/444* (2013.01); *F23G 5/46* (2013.01); *F23G 7/10* (2013.01); *F23G 2201/10* (2013.01); *F23G 2202/40* (2013.01); *F23G 2204/103* (2013.01); *F23G 2205/12* (2013.01); *F23G 2205/14* (2013.01); *F23G 2206/10* (2013.01)

(58) Field of Classification Search

CPC ..... F23G 5/04; F23G 5/46; F23G 2201/10; F23G 2206/10

See application file for complete search history.

(56) References Cited

U.S. PATENT DOCUMENTS 631,298 A * 8/1899 Grill ..... F27B 7/00 432/113
2,095,086 A * 10/1937 Slemmer ..... E01C 19/05 34/63
2,617,545 A * 11/1952 Campbell ..... F26B 11/026 414/149
3,254,882 A * 6/1966 Helming ..... C04B 33/30 106/756

(Continued)

*Primary Examiner* — David J Laux

(74) *Attorney, Agent, or Firm* — McClure, Qualey & Rodack, LLP

(57) ABSTRACT

Disclosed is a combustion machine, including: a hopper, a drying mechanism and a combustion mechanism. The hopper is configured for storing materials and conveying the materials to the drying mechanism. The drying mechanism includes a conveying mechanism and a drying chamber, and the conveying mechanism is connected with the hopper and conveys the materials in the hopper to the drying chamber. The combustion mechanism includes a combustion chamber connected with the drying chamber via a material conveying pipeline, and a fire outlet pipe arranged in the combustion chamber and used for outputting flame. A hot air pipeline is connected between the combustion chamber and the drying chamber, and a first exhaust fan is arranged in the hot air pipeline.

7 Claims, 3 Drawing Sheets

(56) References Cited

U.S. PATENT DOCUMENTS

| | | | | | |
|---|---|---|---|---|---|
| 3,954,069 | A * | 5/1976 | Loken | C02F 11/12 | 110/221 |
| 3,974,784 | A * | 8/1976 | Greenberg | B01D 53/34 | 588/314 |
| 4,047,489 | A * | 9/1977 | Voorheis | F23G 7/02 | 110/342 |
| 4,092,094 | A * | 5/1978 | Lingl, Jr. | F23N 5/188 | 432/1 |
| 4,412,814 | A * | 11/1983 | Dennis, Jr. | F27D 17/004 | 110/102 |
| 4,470,358 | A * | 9/1984 | Prochnow | F23G 5/027 | 110/206 |
| 5,237,938 | A * | 8/1993 | Fujimori | F23G 5/12 | 110/190 |
| 5,865,130 | A * | 2/1999 | Jamison | F23G 7/065 | 110/212 |
| 10,364,985 | B2 * | 7/2019 | Geselle | F23G 5/08 | |

* cited by examiner

COMBUSTION MACHINE

FIELD

The disclosure relates to the technical field of crop treatment, in particular to a combustion machine.

BACKGROUND

At present, fuel should be dried for a combustion machine which uses crops as combusting fuel, and therefore the crops should be dried before putting into the combustion machine for use. Drying and combusting are two mutually independent processes which require separate energy supply, thus causing too high energy consumption.

SUMMARY

The disclosure aims to solve, at least to some extent, one of the above-mentioned technical problems in the related art. Therefore, the disclosure provides a combustion machine capable of reducing energy consumption.

According to the disclosure, there is provided a combustion machine, comprising:

a hopper configured for storing materials and conveying the materials to a drying mechanism, the drying mechanism, comprising:

a drying chamber, and a conveying mechanism connected with the hopper and conveying the materials in the hopper to the drying chamber, and a combustion mechanism, comprising:

a combustion chamber connected with the drying chamber via a material conveying pipeline, and a fire outlet pipe arranged in the combustion chamber and used for outputting flame; and a hot air pipeline connected between the combustion chamber and the drying chamber, and a first exhaust fan being arranged in the hot air pipeline.

The beneficial effects are as follows: hot air generated by combustion in the combustion machine returns to the drying chamber under the action of the first exhaust fan so as to dry materials falling into the drying chamber from the hopper, and the dried materials then enter the combustion machine for combustion to form circulation, no external energy is needed for drying the materials, thus reducing energy consumption.

In some embodiments, an inner container is arranged in the combustion chamber, the material conveying pipeline extends into the combustion chamber and is communicated with the inner container, and a first igniter is arranged in the inner container, and the combustion chamber is further connected with an air duct extending into the combustion chamber and connected with the inner container, and the air duct is connected with a second exhaust fan at an end of the air duct away from the combustion chamber. The first igniter is used for combusting in the inner container, and the combustion chamber is used for heat insulation.

In some embodiments, the inner container is provided with an ash discharge pipe arranged above the inner container and extending out of the combustion chamber, a third exhaust fan is arranged in the ash discharge pipe, the hot air pipeline is communicated with the ash discharge pipe, and a filter screen is arranged in the hot air pipeline. The ash is discharged out of the combustion chamber along the ash discharge pipe under the suction of the first exhaust fan.

In some embodiments, an air chamber is arranged between, and respectively communicated with, the second exhaust fan and the air duct, and an air blowing pipe is arranged between the air chamber and the drying chamber, with one end communicated with the air chamber and the other end connected at a joint where the drying chamber and the material conveying pipeline are connected. The air blowing pipe supplies oxygen for the first igniter to ignite.

In some embodiments, the inner container is internally provided with a gas driving mechanism and a nozzle connected with the gas driving mechanism, the gas driving mechanism is configured for compressing and supplying gas into the nozzle, and the nozzle is configured for injecting the gas to the inner container so that ash accumulated on the inner wall of the inner container falls off, and the ash is discharged out of the combustion chamber along the ash discharge pipe in cooperation with the first exhaust fan.

In some embodiments, the gas driving mechanism comprises an air intake pipe, an acetylene intake pipe, a gas mixer, a second igniter and a pulse generator, and the nozzle is installed on the pulse generator, the air intake pipe and the acetylene intake pipe are respectively communicated with the gas mixer, the gas mixer is communicated with the second igniter, the second igniter is communicated with the pulse generator, and at least one air duct is communicated with the air intake pipe. The acetylene and air are mixed by the gas mixer to form combustible gas, the combustible gas enters the pulse generator after being ignited to form strong-wave jet gas flow, so that ash accumulated on the inner wall of the inner container is subjected to strong vibration and falls off.

In some embodiments, several air ducts are provided, each air duct is provided with a solenoid valve, and at least one of the air ducts is communicated with the air intake pipe. The air ducts provide oxygen for the inner container and air for the gas driving mechanism, and the impact extent of the mixed gas to ash on the inner wall of the inner container can be increased by the plurality of air ducts.

In some embodiments, the combustion chamber is internally provided with a heated net surface which abuts against the inner container, the inner container is provided with an ash discharge opening, an inclined guide groove is arranged below the heated net surface, the inclined guide groove is arranged below the ash discharge opening, an ash collection area with an opening and closing gate is arranged below the ash discharge opening. The remaining ash falls into the ash collection area along the guide rail, and the ash discharge opening is opened for ash treatment after production is finished.

In some embodiments, the drying chamber comprises a housing and a roller rotatable inside the housing, the roller is provided with a plurality of baffles at an inner wall of the roller, and the hot air pipeline extends into the roller. After the materials are inputted into the roller, the baffles of the roller are used for rolling the materials, so that the materials are fully contacted with hot air to improve the drying effect.

In some embodiments, the roller is inclined downwards from a feeding end to a discharging end, which is convenient for material discharging.

BRIEF DESCRIPTION OF THE DRAWINGS

The disclosure is further illustrated by the following drawings and embodiments.

DETAILED DESCRIPTION OF THE EMBODIMENTS

Figure 1:
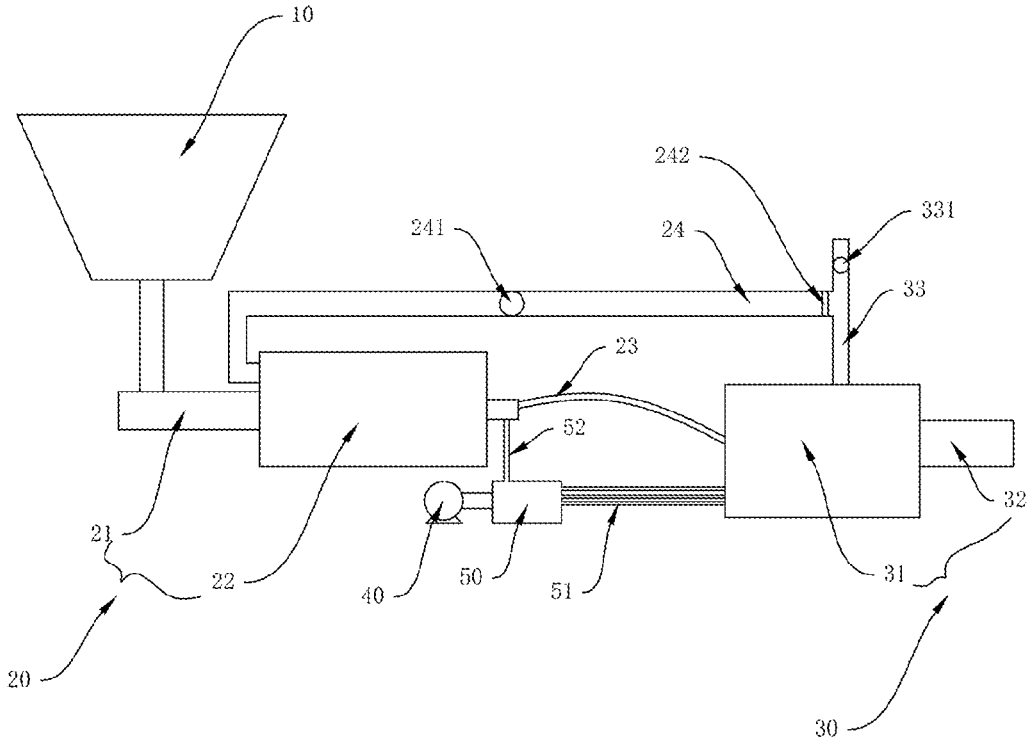
FIG. 1 is a structural schematic view of the disclosure.
Figure 2:
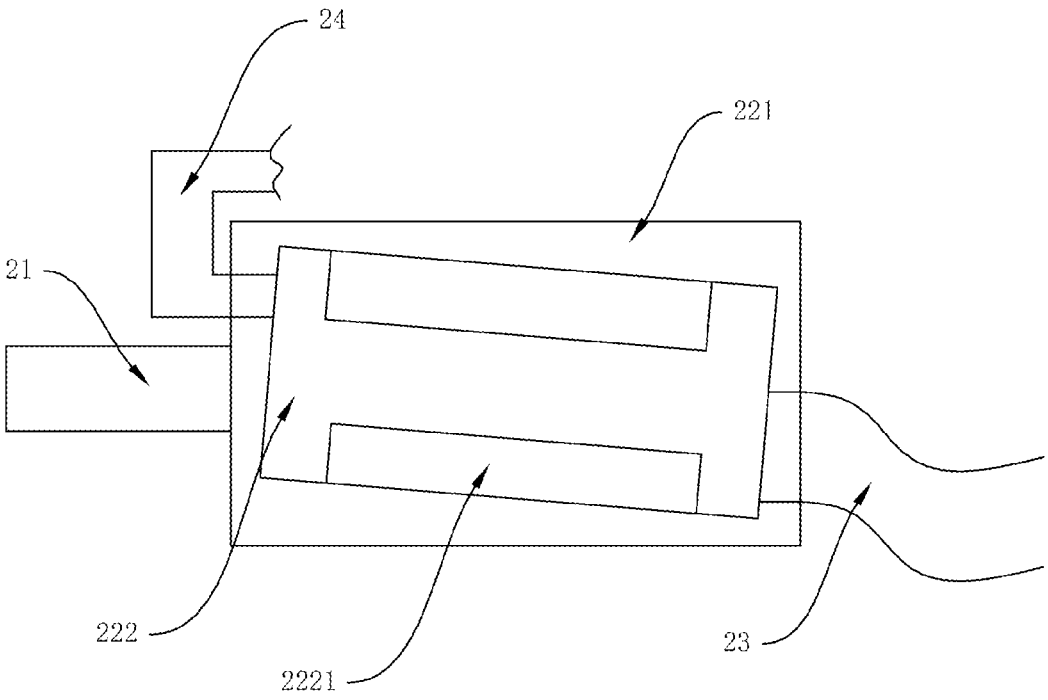
FIG. 2 is a structural schematic view of a drying mechanism of the disclosure.
Figure 3:
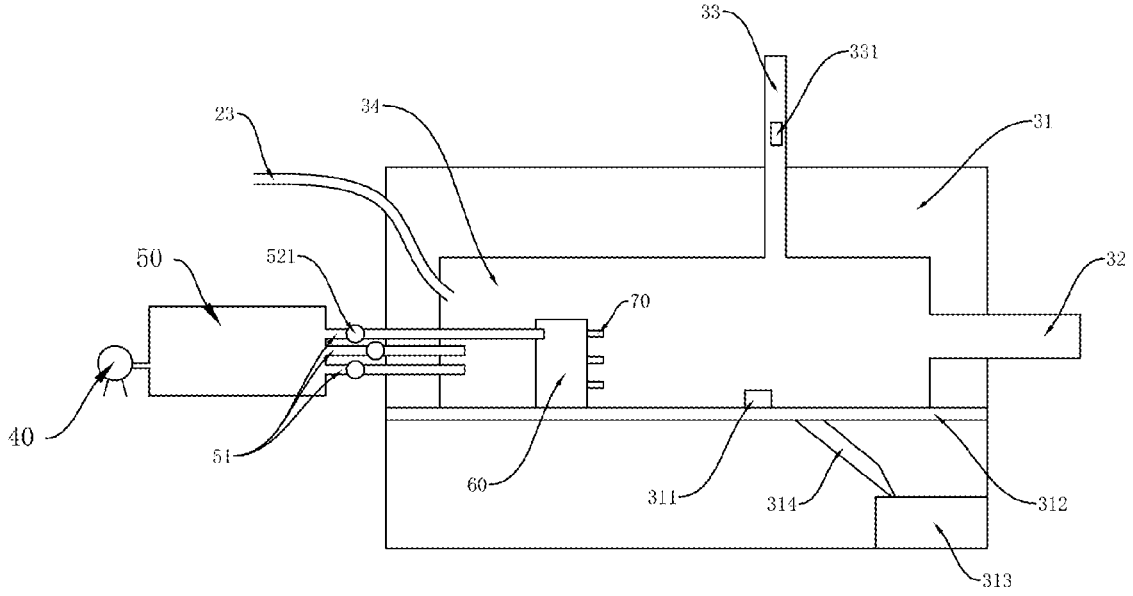
FIG. 3 is a structural schematic view of a combustion mechanism of the disclosure.
Figure 4:
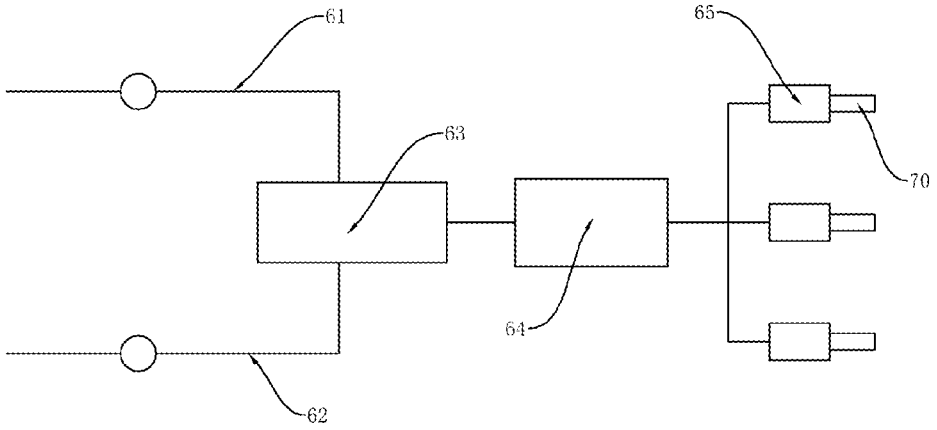
FIG. 4 is a structural schematic view of a gas driving mechanism of the disclosure.

Referring to FIG. 1, a combustion machine according to an embodiment of the disclosure includes a hopper 10, a drying mechanism 20 and a combustion mechanism 30.

The hopper 10 is configured for storing materials and conveying the materials to the drying mechanism 20. It should be mentioned that the hopper 10 is communicated with the conveying mechanism 21 by means of a pipe which is provided with a solenoid switch for controlling the opening or closing of the pipe.

The drying mechanism 20 includes a conveying mechanism 21 and a drying chamber 22, the conveying mechanism 21 is connected with the hopper 10 and conveys the materials in the hopper 10 to the drying chamber 22. Preferably, the conveying mechanism 21 includes a conveying auger.

The combustion mechanism 30 includes a combustion chamber 31 and a fire outlet pipe 32, the combustion chamber 31 is connected with the drying chamber 22 via a material conveying pipeline 23, and the fire outlet pipe 32 is arranged in the combustion chamber 31 and used for outputting flame.

A hot air pipeline 24, within which a first exhaust fan 241 is arranged, is connected between the combustion chamber 31 and the drying chamber 22.

The hot air generated by combustion in the combustion machine returns to the drying chamber 22 under the action of the first exhaust fan 241 so as to dry the materials falling into the drying chamber 22 from the hopper 10, the dried materials then enter the combustion machine for combustion to form circulation, with the materials dried without external energy and the energy consumption reduced.

As an improvement of the technical solution, an inner container 34 is arranged in the combustion chamber 31, the material conveying pipeline 23 extends into the combustion chamber 31 and is communicated with the inner container 34, and a first igniter 311 is arranged in the inner container 34. The combustion chamber 31 is further connected with an air duct 51 extending into the combustion chamber 31 and connected with the inner container 34, and the air duct 51 is connected with a second exhaust fan 40 at one end of the air duct 51 away from the combustion chamber 31.

By activating the first igniter 311, the fuel is combusted in the inner container 34 and insulated by the combustion chamber 31 to prevent heat from affecting the surrounding working equipment.

As a further improvement of the technical solution, the inner container 34 is provided with an ash discharge pipe 33 above the inner container 34 and extending out of the combustion chamber 31, a third exhaust fan 331 is arranged in the ash discharge pipe 33, the hot air pipeline 24 is communicated with the ash discharge pipe 33, and a filter screen 242 is arranged in the hot air pipeline 24.

A large amount of ash generated during combustion is discharged out of the combustion chamber 31 along the ash discharge pipe 33 under the suction of the first exhaust fan 241.

In some embodiments, an air chamber 50 is arranged between, and respectively communicated with, the second exhaust fan 40 and the air duct 51. An air blowing pipe 52 is arranged between the air chamber 50 and the drying chamber 22, one end of the air blowing pipe 52 is communicated with the air chamber 50, and the other end of the air blowing pipe 52 is connected at the joint where the drying chamber 22 and the material conveying pipeline 23 is connected.

The air duct 51 provides oxygen for the first igniter 311 to ignite, and meanwhile, after air enters the air chamber 50, an opening of air is outputted from the air duct 51 to drive the fuel to enter the combustion chamber 31. It should be noted that, several air ducts 51 are provided, each air duct is provided with a solenoid valve 521, so as to control the opening or closing of the air duct 51, and then control the amount of oxygen for entering the inner cavity and the fire intensity.

In some embodiments, the inner container 34 is further provided with a gas driving mechanism 60 and a nozzle 70, the nozzle 70 is connected to the gas driving mechanism 60, the gas driving mechanism 60 is configured for compressing and supplying gas into the nozzle 70, and the nozzle 70 injects the gas to the inner container 34.

In the actual use, most of the ash may cover the inner wall of the inner cavity and is difficult to suck away. By injecting gas from the nozzle with the gas driving mechanism 60, the ash accumulated on the inner wall of the inner container 34 can fall off and be discharged out of the combustion chamber 31 along the ash discharge pipe 33 in cooperation with the first exhaust fan 241.

Preferably, the gas driving mechanism 60 includes an air intake pipe 61, an acetylene intake pipe 62, a gas mixer 63, a second igniter 64 and a pulse generator 65. The nozzle 70 is installed on the pulse generator 65, the air intake pipe 61 and the acetylene intake pipe 62 are respectively communicated with the gas mixer 63, the gas mixer 63 is communicated with the second igniter 64, the second igniter 64 is communicated with the pulse generator 65, and at least one of the air ducts 51 is communicated with the air intake pipe 61. The acetylene and air are mixed by the gas mixer 63 to form combustible gas, the combustible gas enters the pulse generator 65 after being ignited to form strong-wave jet gas flow, so that ash accumulated on the inner wall of the inner container 34 is subjected to strong vibration and falls off.

In some embodiments, a heated net surface 312 which abuts against the inner container 34 is arranged in the combustion chamber 31, the inner container 34 is provided with an ash discharge opening, an inclined guide groove 314 is arranged below the heated net surface 312, the inclined guide groove 314 is arranged below the ash discharge opening, an ash collection area 313 is arranged below the ash discharge opening, and the ash collection area 313 is provided with an opening and closing gate. In the actual cleaning process, a part of the ash cannot be sucked away by air suction, the remaining ash falls into the ash collection area 313 along the guide rail by using the injected gas, and the ash discharge opening is opened for ash treatment after production is finished.

In some embodiments, the drying chamber 22 includes a housing 221 and a roller 222 rotatable inside the housing 221, the roller 222 is provided with a plurality of baffles 2221 at an inner wall of the roller, and the hot air pipeline 24 extends into the roller 222. After the materials are inputted into the roller 222, the baffles 2221 of the roller 222 are used for rolling the material, so that the material is fully contacted with hot air to improve the drying effect.

In some embodiments, the roller 222 is inclined downwards from a feeding end to a discharging end. Due to the action of gravity, fuel can be discharged conveniently.

While the preferred embodiments of the disclosure have been particularly described with reference to the above specific structural and dimensional data, the disclosure is not limited to the embodiments. It will be understood by those skilled in the art that various equivalents and alternatives may be made therein without departing from the principle of the disclosure, and these equivalents and alternatives shall all fall within the scope as defined by the appended claims.

The invention claimed is:

1. A combustion machine, comprising:

a hopper configured for storing materials and conveying the materials to a drying mechanism, the drying mechanism, comprising:

a drying chamber, and a conveying mechanism connected with the hopper and conveying the materials in the hopper to the drying chamber, and a combustion mechanism, comprising:

a combustion chamber connected with the drying chamber via a material conveying pipeline, and a fire outlet pipe arranged in the combustion chamber and used for outputting flame; and a hot air pipeline connected between the combustion chamber and the drying chamber, and a first exhaust fan being arranged in the hot air pipeline;

wherein, the drying chamber comprises a housing and a roller rotatable inside the housing, the roller is provided with a plurality of baffles at an inner wall of the roller, and the hot air pipeline extends into the roller; wherein:

an inner container is arranged in the combustion chamber, the material conveying pipeline extends into the combustion chamber and is communicated with the inner container, and a first igniter is arranged in the inner container;

the combustion chamber is further connected with an air duct extending into the combustion chamber and connected with the inner container, and the air duct is connected with a second exhaust fan at an end of the air duct away from the combustion chamber; and the first igniter is configured for initiating an ignition for the combustion chamber through oxygen from the air duct;

an air chamber is arranged between, and respectively communicated with, the second exhaust fan and the air duct, and an air blowing pipe is arranged between the air chamber and the drying chamber, with one end communicated with the air chamber and the other end connected at a joint where the drying chamber and the material conveying pipeline are connected.

2. The combustion machine according to claim 1, wherein the inner container is provided with an ash discharge pipe arranged above the inner container and extending out of the combustion chamber, a third exhaust fan is arranged in the ash discharge pipe, the hot air pipeline is communicated with the ash discharge pipe, and a filter screen is arranged in the hot air pipeline.

3. The combustion machine according to claim 1, wherein the inner container is internally provided with a gas driving mechanism and a nozzle connected with the gas driving mechanism, the gas driving mechanism is configured for compressing and supplying gas into the nozzle, and the nozzle is configured for injecting the gas to the inner container.

4. The combustion machine according to claim 3, wherein the gas driving mechanism comprises an air intake pipe, an acetylene intake pipe, a gas mixer, a second igniter and a pulse generator, wherein the nozzle is installed on the pulse generator, the air intake pipe and the acetylene intake pipe are respectively communicated with the gas mixer, the gas mixer is communicated with the second igniter, the second igniter is communicated with the pulse generator, and at least one air duct is communicated with the air intake pipe.

5. The combustion machine according to claim 4, wherein several air ducts are provided, each air duct is provided with a solenoid valve, and at least one of the air ducts is communicated with the air intake pipe.

6. The combustion machine according to claim 1, wherein the combustion chamber is internally provided with a heated net surface which abuts against the inner container, the inner container is provided with an ash discharge opening, an inclined guide groove is arranged below the heated net surface, the inclined guide groove is arranged below the ash discharge opening, an ash collection area with an opening and closing gate is arranged below the ash discharge opening.

7. The combustion machine according to claim 1, wherein the roller is inclined downwards from a feeding end to a discharging end.

* * * * *